US007575240B1

(12) United States Patent
Voden

(10) Patent No.: US 7,575,240 B1
(45) Date of Patent: Aug. 18, 2009

(54) COLLAPSIBLE GAME TABLE

(76) Inventor: Justin L. Voden, W244 S6945 Maple Hill Dr., Waukesha, WI (US) 53189

( * ) Notice: Subject to any disclaimer, the term of this patent is extended or adjusted under 35 U.S.C. 154(b) by 169 days.

(21) Appl. No.: 10/907,475

(22) Filed: Apr. 1, 2005

(51) Int. Cl.
*A63F 9/00* (2006.01)

(52) U.S. Cl. ..... 273/309

(58) Field of Classification Search ..... 273/285, 273/309; 40/365, 366; 108/167; 473/15
See application file for complete search history.

(56) References Cited

U.S. PATENT DOCUMENTS

| | | | | | |
|---|---|---|---|---|---|
| 161,502 | A | * | 3/1875 | Gilbert | 273/284 |
| 735,995 | A | * | 8/1903 | Mumford | 273/118 R |
| 940,283 | A | * | 11/1909 | Samuel | 52/782.21 |
| 1,886,806 | A | * | 11/1932 | Hanley | 108/90 |
| 1,906,213 | A | * | 4/1933 | Ratner et al. | 108/25 |
| 1,989,258 | A | * | 1/1935 | Bair | 273/309 |
| 2,754,167 | A | * | 7/1956 | Young | 312/285 |
| 2,768,047 | A | * | 10/1956 | Strauss | 312/242 |
| 3,964,403 | A | | 6/1976 | Schankman | |
| 4,041,880 | A | | 8/1977 | Schankman | |
| 4,318,543 | A | * | 3/1982 | Vollendorf | 473/7 |
| 4,579,342 | A | | 4/1986 | Mortensen | |
| 4,927,140 | A | * | 5/1990 | Pappas | 473/8 |
| 5,078,404 | A | * | 1/1992 | Barillaro et al. | 273/285 |
| 5,327,838 | A | * | 7/1994 | Beltman | 108/25 |
| 5,362,063 | A | | 11/1994 | Cummings | |
| 6,041,722 | A | | 3/2000 | Baker | |
| 6,120,030 | A | * | 9/2000 | Chou | 273/284 |
| 6,349,939 | B1 | * | 2/2002 | Tsai | 273/108.1 |
| 6,616,141 | B2 | | 9/2003 | Diamant | |
| 6,634,646 | B2 | | 10/2003 | Wolpert et al. | |
| 6,926,278 | B2 | * | 8/2005 | Bibi | 273/284 |
| D521,570 | S | * | 5/2006 | Tsai | D21/397 |
| 7,156,396 | B1 | * | 1/2007 | Voden | 273/285 |
| 2005/0001380 | A1 | * | 1/2005 | Winter et al. | 273/309 |

* cited by examiner

*Primary Examiner*—Gene Kim
*Assistant Examiner*—Alyssa M Hylinski
(74) *Attorney, Agent, or Firm*—Ziolkowski Patent Solutions Group, SC

(57) ABSTRACT

A folding game table having a collapsible construction is disclosed. The folding game table has a pair of table members interconnected with at least one hinge and movable between an extended position and a folded position. At least one game template is configured to be removably positioned on at least one of the pair of table sections for game play thereon.

8 Claims, 5 Drawing Sheets

COLLAPSIBLE GAME TABLE

BACKGROUND OF THE INVENTION

The present invention relates generally to game tables and, more particularly, to a multi-game collapsible game table.

Poker tables generally consist of a relatively flat surface with a felt or comparable material positioned thereover. In order to maintain the quality and condition of the cover material of the table as well as reduce any obstructions to game play, players often prefer some additional space away from the play surface for food and drink as well as poker chips or other win/loss indicators. Additionally, ancillaries associated with game play such as cards, dice, poker chips, and the like, should preferably be kept with the table in order to keep these related game-playing elements from being misplaced.

Another consideration of game table design is game format. The game format is the game pattern or indicia provided on the game playing surface to aid in game flow. Several game formats that can be provided on the game playing surface include a roulette, craps, poker, cricket, dog track, and blackjack to name but a few. A variety of game patterns, each including distinct game indicia, positionable on the play surface provide for a multi-use game table.

In addition to the space and format considerations addressed above, another consideration to game table construction is whether the table be constructed for permanent setup or for temporary setup and storage thereafter. That is, some of these tables are only used periodically and are only set up for game time and then stored shortly thereafter. It is desirable to store the table in a minimum of space compared to the amount of space occupied by the table when it is set up. Some prior art tables have provided a collapsible leg system for the tables but do not provide means for collapsing the table surface.

Depending partly on which game is to be played on the game table, a deflection panel system is sometimes advantageous to have positioned about the gaming surface. Particularly, for the game of craps when a shooter repeatedly tosses a pair of dice across the table, a deflection panel system assists in confining the playing materials to the playing surface. Some game tables have panel systems that are either permanently affixed about a perimeter of the playing surface or are removably attached to the playing surface. These panel systems detract from the collapsibility of the gaming table or are generally inconvenient to set up and take down, respectively.

It would therefore be desirable to have a game table and method of altering a game format that is quickly and simply collapsible into compact dimensions and provides a plurality of interchangeable game formats.

BRIEF DESCRIPTION OF THE INVENTION

The present invention is directed to a folding game table that solves the aforementioned problems. The game table has a pair of table top sections pivotably interconnected to be movable between an extended position and a folded position. A game template is positioned generally about a play surface of the game table and interchangeably secured thereto.

Therefore, in accordance with one aspect of the present invention, a folding game table is disclosed that includes a pair of table sections and at least one hinge configured to interconnect the pair of table sections and configured to permit the pair of table sections to be movable between an extended position and a folded position. The folding game table also includes at least one game template mounted to each of the pair of table sections and at least one game piece storage compartment disposed in a play surface of the pair of table sections.

In accordance with another aspect of the present invention, a folding game table is disclosed that includes a pair of table sections and at least one hinge configured to interconnect the pair of table sections and configured to permit the pair of table sections to be movable between an extended position and a folded position. The folding game table also includes at least one game template detachably mounted to at least one of the pair of table sections and a dice stop constructed to removably couple to at least one of the pair of table sections.

In accordance with a yet another aspect of the present invention, a folding game table is disclosed that includes a first table section having a first game surface portion thereon and a second table section having a second game surface portion thereon, wherein the first and second game surface portions form a contiguous game play surface. The folding game table also includes at least one hinge attached to the first and second table sections and configured to permit the first and second table sections to be movable between a play position and a storage position and a first game template removably positioned on the first game surface portion. The folding game table further includes at least one multi-position tab slidably mounted to the first table section and having a portion thereof extending over the first game template when positioned in a first position.

Various other features, objects, and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

Figure 1:
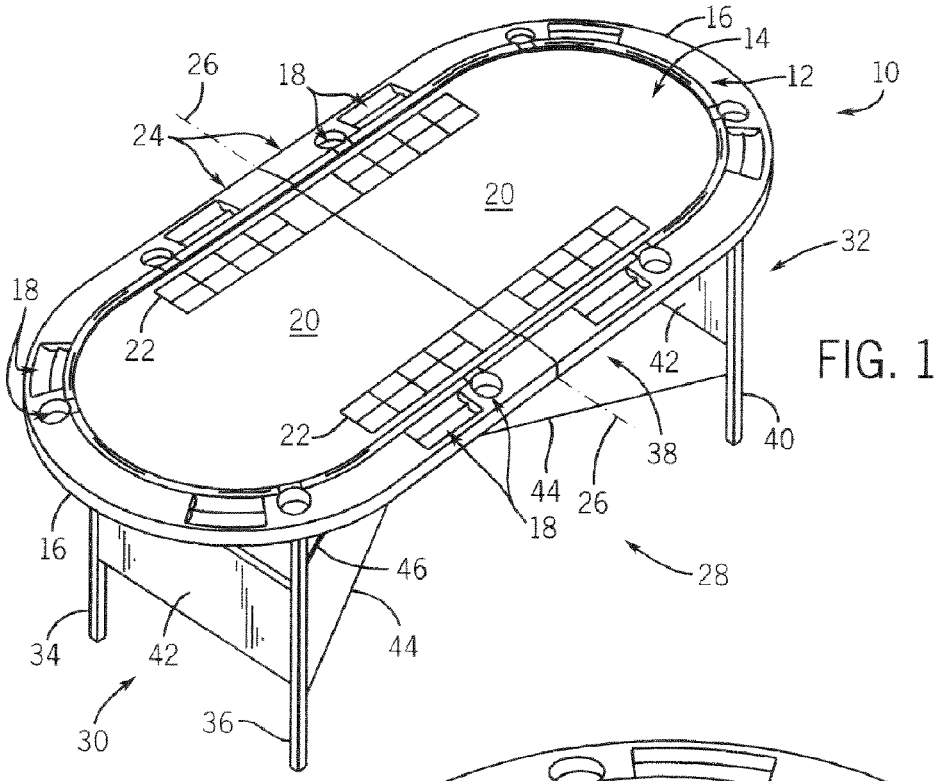
FIG. 1 is a perspective view of a collapsible game table according to the present invention shown in an extended position.

FIG. 1 shows a game table 10 having a rail 12 positioned adjacent to a play surface 14. Rail 12 includes a plurality of individual rail sections 16 that cooperate to encompass play surface 14. A plurality of recesses 18 is formed in rail 12 and configured to provide game players with a storage location for game play ancillaries such as poker chips and/or drinks. Providing player positioning of drinks and chips off of play surface 14 improves the flow of the game and maintains the cleanliness of play surface 14. A plurality of table inserts 20 is positioned on play surface 14 and includes game indicia 22.

Game indicia 22 include a wide variety of markings associated with game play. Such indicia can include, for example, patterns associated with roulette, blackjack, craps, and poker, to name but a few.

Game table 10 includes a pair of table top sections 24 pivotably connected about a hinge axis 26. A leg assembly 28 includes a first set of legs 30 and a second set of legs 32 generally disposed at opposite ends of game table 10. Each set of legs 30, 32 includes a pair of legs 34, 36 and 38, 40, respectively. A brace 42 extends between each of legs 34, 36, and between 38, 40. A strap 44, or cable, extends under game table 10 between diagonally opposite legs of leg assembly 28. Such an orientation reduces interference of strap 44 with players positioned about game table 10 and forms a relatively robust support system of game table 10.

Figure 4:
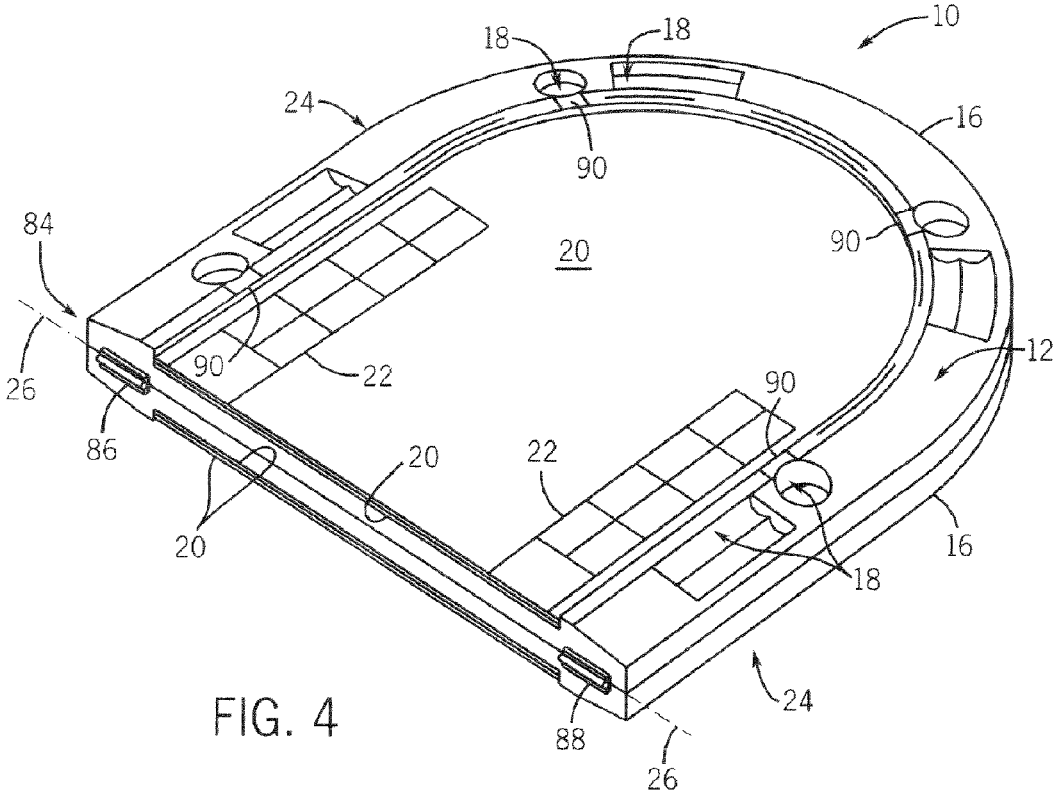
FIG. 4 is a perspective view of the game table of FIG. 1 in a collapsed position.

A bracket 46 extends between each set of legs 30, 32 and table top sections 24. Brackets 46 are constructed to allow each set of legs 30, 32 to be folded under table top sections 24 thereby collapsing game table 10 into a generally planar orientation without the legs extending perpendicularly therefrom. The collapsed orientation of game table 10 is shown in FIG. 4 and discussed therewith.

Figure 2:
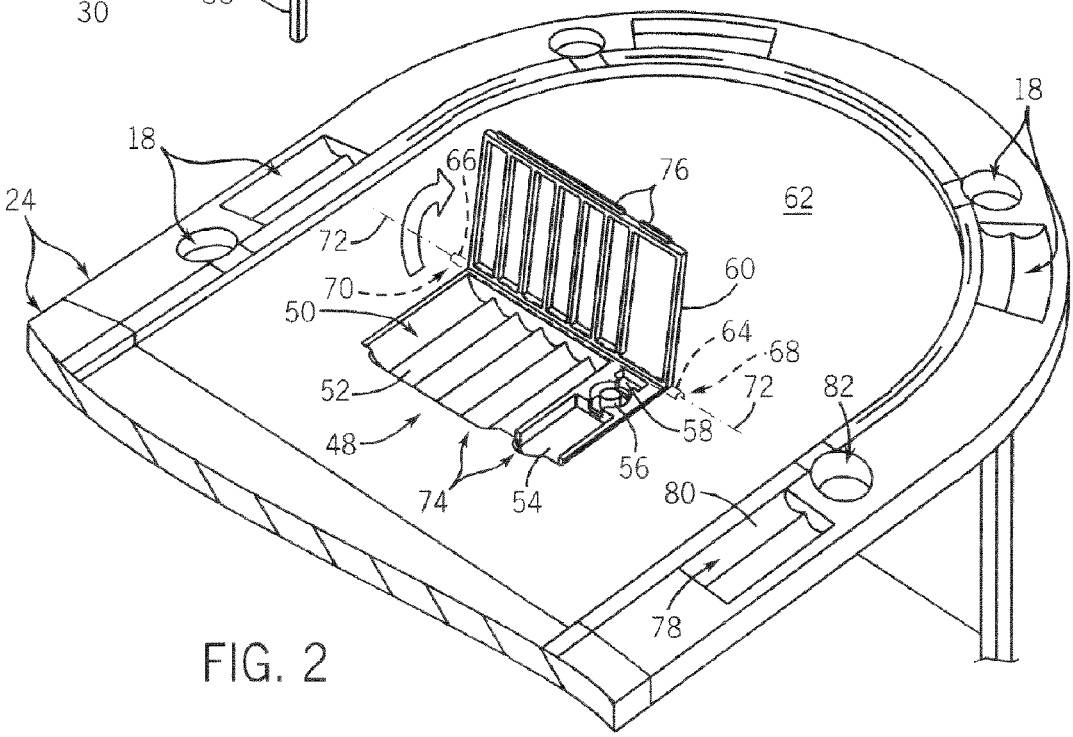
FIG. 2 is a partial perspective view of the game table of FIG. 1 showing a game accessory storage system.

FIG. 2 shows a game accessory storage system 48 for storing game ancillaries. Game accessory storage system 48 includes a storage recess 50 formed in at least one table top section 24. Storage recess 50 has at least one accessory well 52 formed in a bottom thereof for placing game accessories (not shown) therein. In a preferred embodiment, a plurality of accessory wells 52-58 is formed in storage recess 50 for placing a variety of game accessories therein. For example, accessory well 52 has a wave shape, each wave formed to hold a plurality of poker chips therein. Accessory wells 54, 56, and 58 may be formed to hold a deck of cards, a dealer button, and a set of dice, respectively.

A cover 60 rotatably attaches to a top surface 62 of table top section 24 and encloses storage recess 50 when positioned in a closed position. In this manner, cover 60 encloses game accessories placed in storage recess 50 such that the game accessories may be stored with game table 10. A pair of rotation pins 64, 66 extend from cover 60 and insert into corresponding recesses 68, 70, respectively, formed in top surface 62 to form a hinge system and provide a rotation axis 72 about which cover 60 rotates. Cover 60 is preferably flush with top surface 62 when positioned in a closed position. In this manner, interference between cover 60 and table insert 20 is minimized. At least one recess 74 formed in top surface 62 permits an object such as a finger to be inserted under a lip 76 of cover 60 for moving cover 60 from a closed position to an open position.

Still referring to FIG. 2, a first recess 78 formed in rail 12 has an accessory pocket or well 80 formed in a bottom thereof for placing game accessories (not shown) therein. For example, recess 78 may include a "w"-shaped accessory well for placing poker chips therein during game play. A variety of accessory wells 80 may be formed in recess 78 and may be shaped to hold a variety of game accessories therein such as poker chips, dice, and cards. A second recess 82 may be formed in rail 12 to hold objects such as a cup or food items. In this manner, recess 82 provides player positioning of drinks and chips off of play surface 14 and improves the flow of the game by maintaining the cleanliness of play surface 14.

Figure 3:
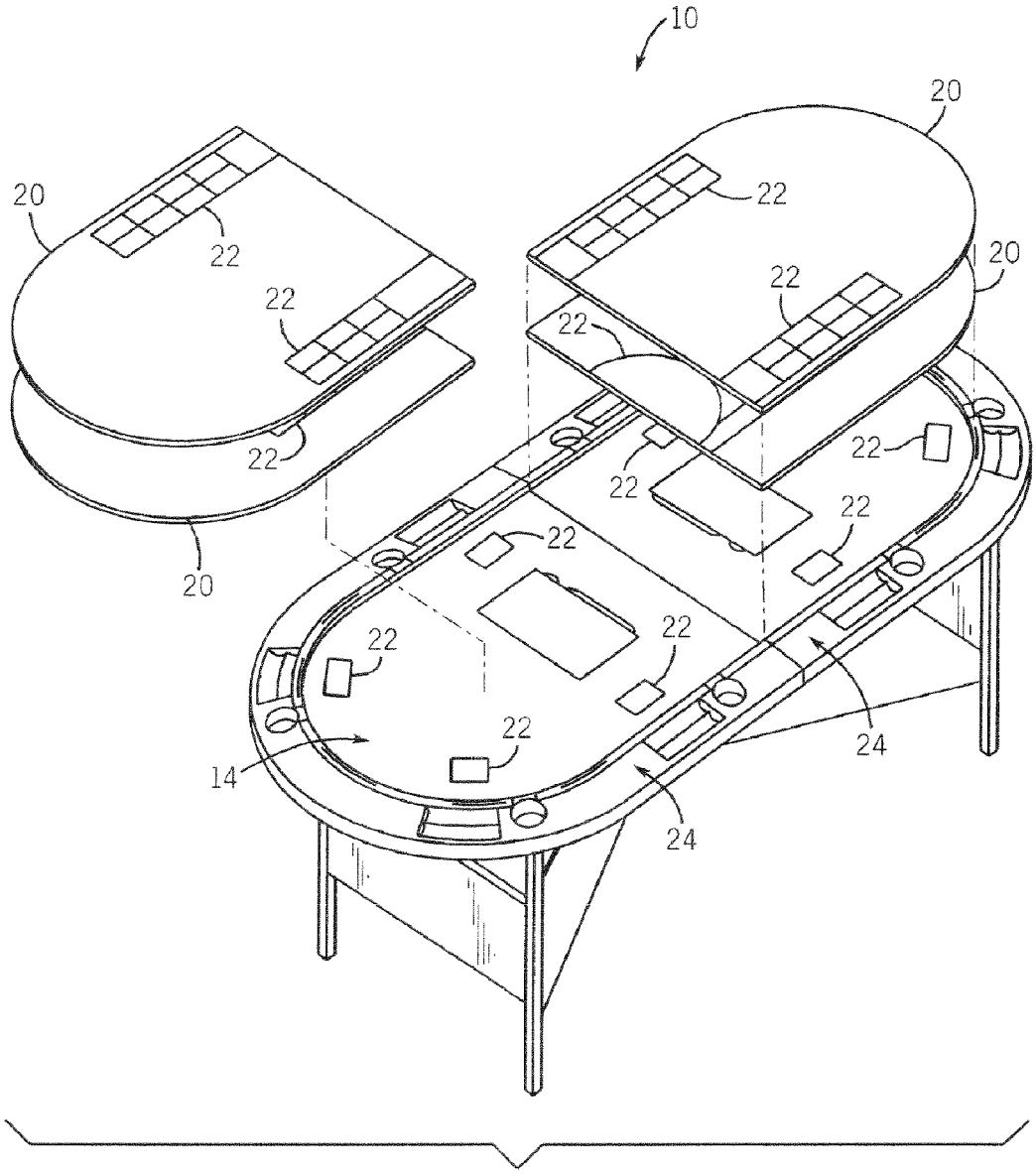
FIG. 3 is a perspective exploded view of the game table of FIG. 1.

FIG. 3 shows a perspective exploded view of game table 10. The plurality of table inserts 20 is detachably mounted to game table 10 and allows game play thereon. Each table insert 20 has two sides, each side having game indicia 22 thereon allowing the plurality of table inserts 20 to be turned over to reveal a different set of game indicia on the opposite side. Additionally, the plurality of table inserts 20 may be removed from play surface 14 to reveal game indicia 22 on table top sections 24 to allow game play on play surface 14 without table insert 20 positioned thereon. The plurality of table inserts 20 is preferably made of a rigid material such as laminated felt; however, other materials such as cardboard, wood, and the like may also be used.

FIG. 4 shows a perspective view of game table 10 in a collapsed position. Leg assembly 28 folds under table sections 24 and table sections 24 rotate together about hinge axis 26 thereby providing a folded table length that is half of the extended table length shown in FIG. 1. A hinge assembly 84 attaches to and interconnects table top sections 24 and allows table top sections 24 to pivot about hinge axis 26. Hinge assembly 84 may include multiple hinges 86 and 88, as shown in FIG. 4, or a single hinge such as a piano hinge.

Still referring to FIG. 4, a game pattern retaining system is shown for securing the plurality of table inserts 20 to game table 10. The game pattern retaining system includes a plurality of multi-position tabs 90 extendible over play surface 14 to secure at least one table insert 20 to game table 10. As shown in FIG. 4, the plurality of multi-position tabs 90 are positioned in a retracted position. In the retracted position, the plurality of multi-position tabs 90 are retracted from play surface 14 and are decoupled from retaining table insert 20, allowing table insert 20 to be positioned on or removed from game table 10. In an extended position (shown in FIG. 5), the plurality of multi-position tabs 90 extends over play surface 14 and slidably couples to table insert 20. The plurality of extended multi-position tabs 90 combine to secure table insert 20 to game table 10 such that table insert 20 remains coupled to game table 10 as game table 10 is stored or transported from one location to another.

To mount table insert 20 to game table 10, table insert 20 is placed on play surface 14 with the plurality of multi-position tabs 90 retracted from play surface 14. The plurality of multi-position tabs 90 are then extended to overlap and slidably engage table insert 20. Table insert 20 is removable for changing of game indicia 22 and for accessing storage recess 50. Table insert 20 may be removed from game table 10 by retracting the plurality of multi-position tabs 90 from table insert 20. With the plurality of multi-position tabs 90 retracted, table insert 20 may be removed from play surface 14. Table insert 20 can be turned over to reveal a different game pattern illustrated on an opposite side or set aside to expose game indicia 22 on table top sections 24.

Figure 5:
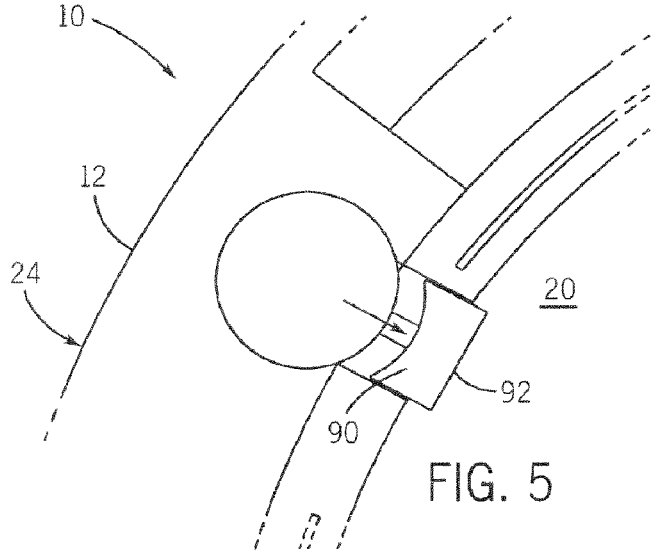
FIG. 5 is a top plan view of a portion of the game table of FIG. 4 showing a locking tab assembly.

FIG. 5 shows one of the plurality of multi-position tabs 90 in an extended position. In the extended position, a front portion 92 of multi-position tab 90 extends over the play surface 14 and overlaps table insert 20. Multi-position tab 90 slidably engages and couples to table insert 20 to minimize movement of table insert 20 away from or along play surface 14. In this manner, table insert 20 is connected to game table 10 for game play, storage, and/or transport.

Figure 6:
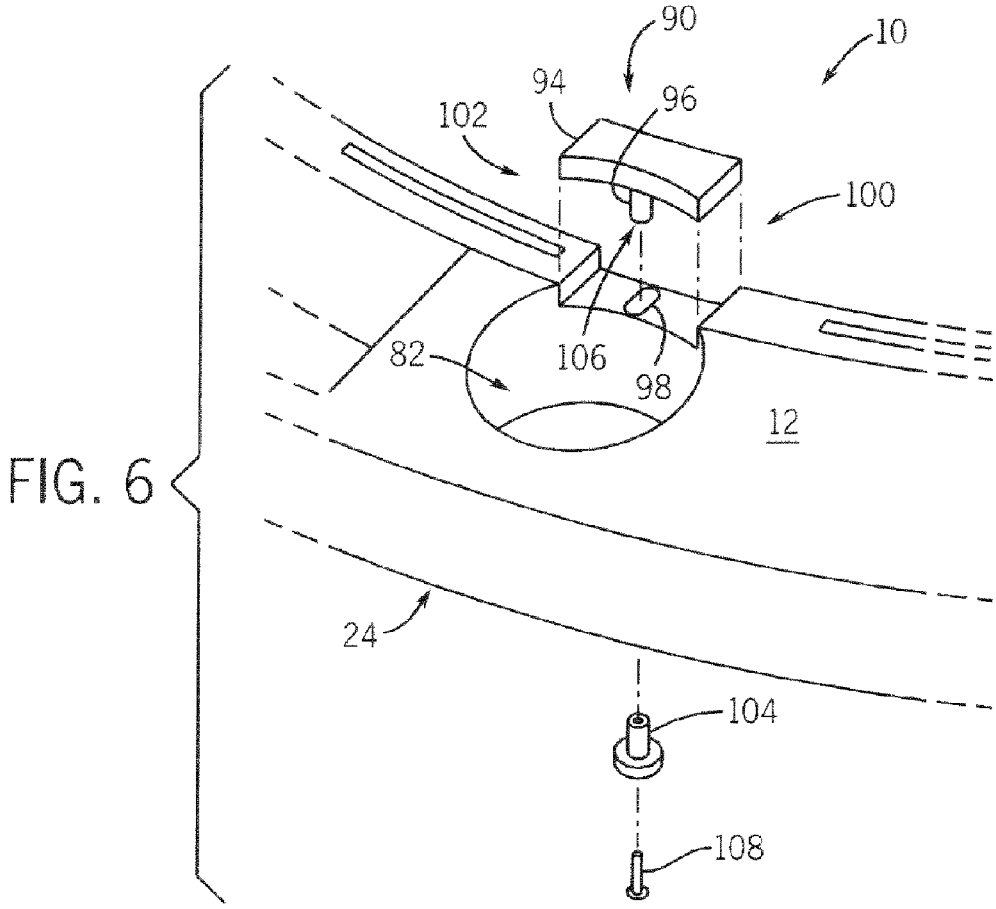
FIG. 6 is a perspective exploded view of the locking tab assembly of FIG. 5.

FIG. 6 shows a perspective exploded view of a multi-position tab 90 of game table 10. Multi-position tab 90 includes a base 94 having a stem 96 extending therefrom. An aperture 98 formed in rail 12 allows passage of stem 96 therein. A grommet 104 extends through aperture 98 and, preferably, into a hole 106 formed in stem 96. A fastener 108 frictionally attaches grommet 104 to stem 96. Alternatively, grommet 104 may abut stem 96 such that a threaded fastener 108 extending therethrough threadedly engages stem 96 and attaches grommet 104 to stem 96.

Aperture 98 is preferably connected to a recess 100 formed in rail 12 configured to allow movement of base 94 therein. Recess 100 may be fluidly connected to recess 82. A rear portion 102 of base 94 may be shaped to substantially match a portion of recess 82 such that rear portion 102 substantially aligns with a portion of recess 82 when multi-position tab 90 is in a retracted position. For example, as shown in FIG. 6, recess 82 is cylindrically shaped to hold a beverage cup and/or food. Rear portion 102 of base 94 has an arcuate shape whose curvature substantially matches the curvature of cylindrically shaped recess 82.

Figure 7:
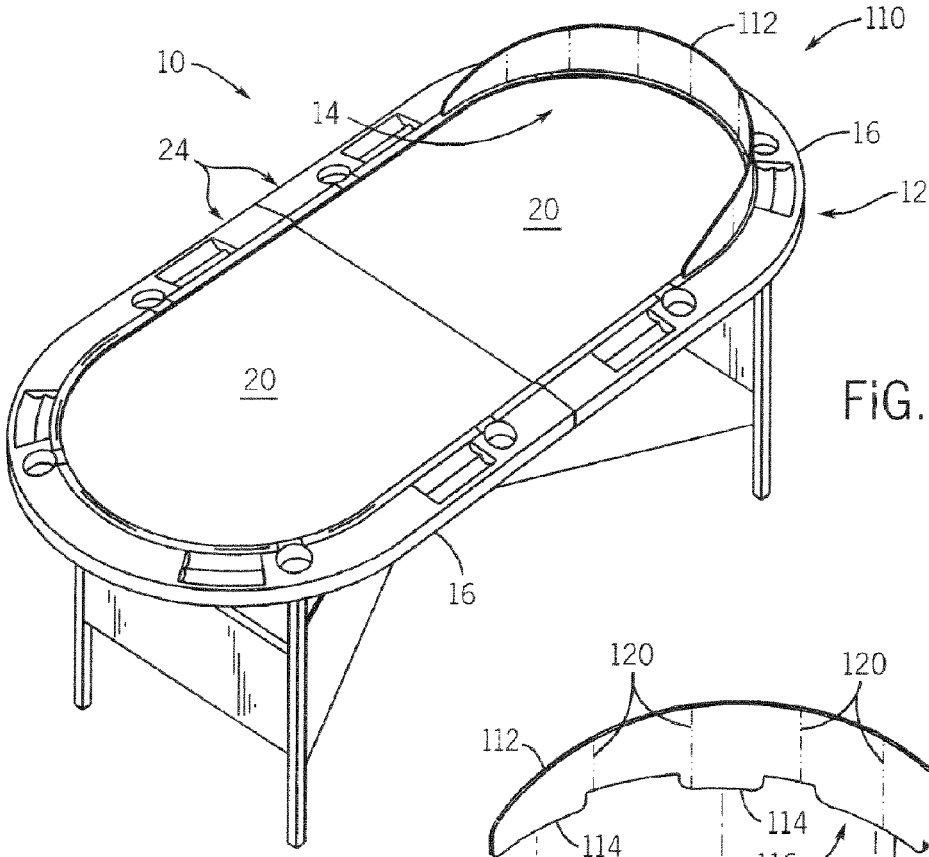
FIG. 7 is a perspective view of the game table of FIG. 1 including a removable deflection panel system.

FIG. 7 is a perspective view of game table 10 showing a removable panel system 110. Removable panel system 110 includes a panel 112 slidably engageable with rail 12 of game table 10. Removable panel system 110 is useful for dice games, such as craps, in which it is desirable, or even mandatory, to throw dice against for deflection toward play surface 14. Panel 112 extends outwardly from rail 12 and provides a backstop against which dice or other game ancillaries may be thrown.

Figure 8:
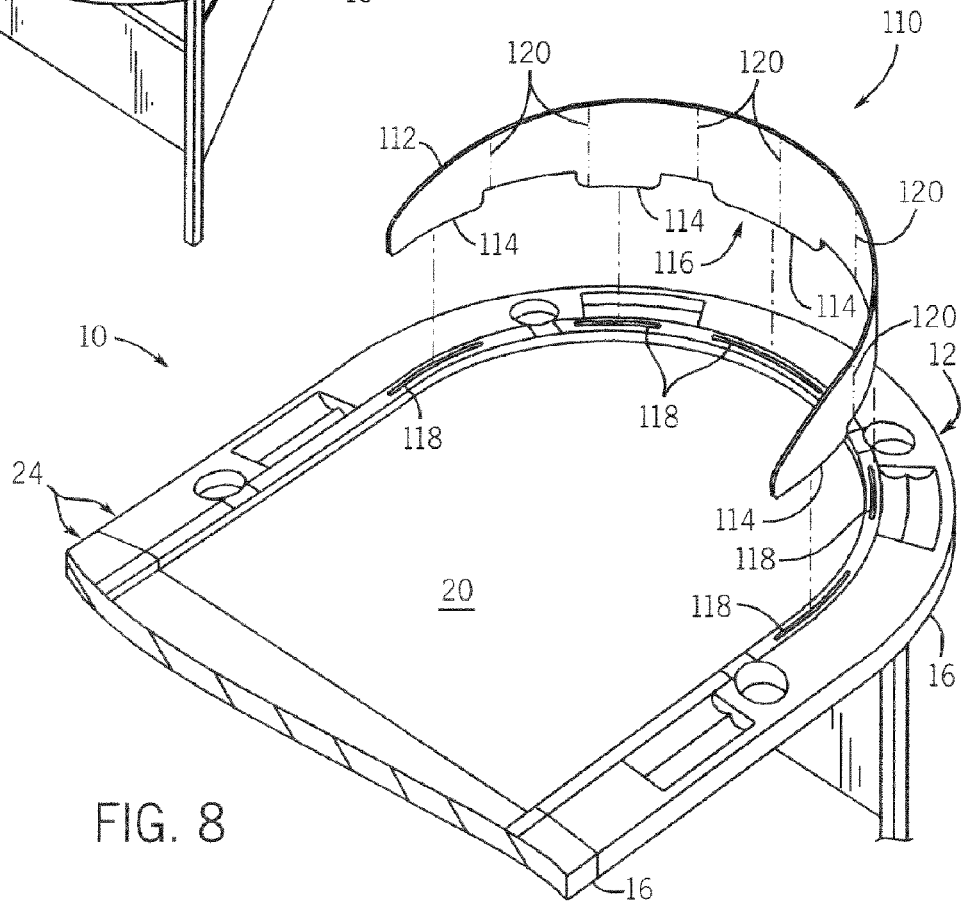
FIG. 8 is a partial perspective view of the game table of FIG. 7 having the removable deflection panel system exploded therefrom.

FIG. 8 is a perspective exploded view of the removable panel system 110. Panel 112 includes a plurality of tabs 114 extending from a bottom edge 116. A plurality of slots 118 formed in rail 12 slidably receive tabs 114 therein. To couple panel 112 to rail 12, each of the plurality of tabs 114 is aligned with a corresponding slot 118 and inserted therein. Panel 112 is constructed of a flexible material to allow panel 112 to conform to either a linear arrangement or a non-linear arrangement of slots 118.

Figure 9:
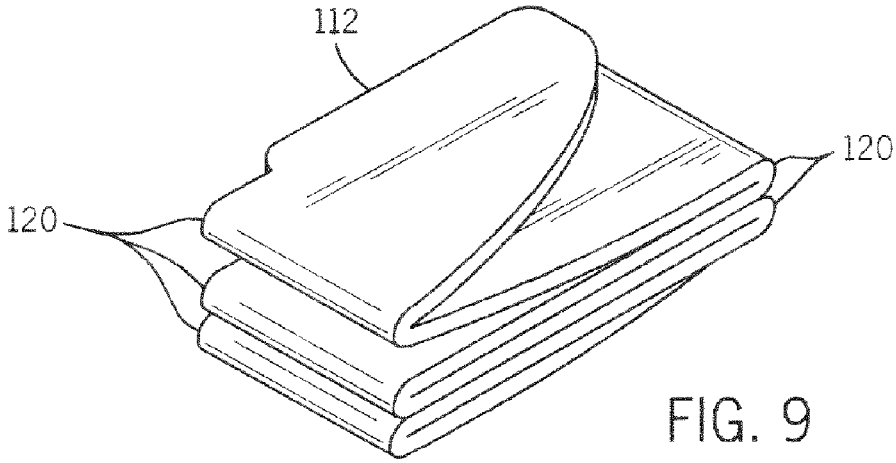
FIG. 9 is a perspective view of the removable deflection panel of FIG. 7 shown in a collapsed storable position.

As shown in FIG. 9, panel 112 folds along folding grooves 120 for compact storage. Folded panel 112 may be stored in a panel storage recess (not shown) formed in a table top section 24 or formed in a bottom portion of table top section 24. In this manner, panel 112 may stored with game table 10 and may be removed therefrom when required.

In accordance with one embodiment of the present invention, a folding game table is disclosed that includes a pair of table sections and at least one hinge configured to interconnect the pair of table sections and configured to permit the pair of table sections to be movable between an extended position and a folded position. The folding game table also includes at least one game template mounted to each of the pair of table sections and at least one game piece storage compartment disposed in a play surface of the pair of table sections.

In accordance with another embodiment of the present invention, a folding game table is disclosed that includes a pair of table sections and at least one hinge configured to interconnect the pair of table sections and configured to permit the pair of table sections to be movable between an extended position and a folded position. The folding game table also includes at least one game template detachably mounted to at least one of the pair of table sections and a dice stop constructed to removably couple to at least one of the pair of table sections.

In accordance with a yet another embodiment of the present invention, a folding game table is disclosed that includes a first table section having a first game surface portion thereon and a second table section having a second game surface portion thereon, wherein the first and second game surface portions form a contiguous game play surface. The folding game table also includes at least one hinge attached to the first and second table sections and configured to permit the first and second table sections to be movable between a play position and a storage position and a first game template removably positioned on the first game surface portion. The folding game table further includes at least one multi-position tab slidably mounted to the first table section and having a portion thereof extending over the first game template when positioned in a first position.

The present invention has been described in terms of the preferred embodiment, and it is recognized that equivalents, alternatives, and modifications, aside from those expressly stated, are possible and within the scope of the appending claims.

What is claimed is:

1. A folding game table comprising:

a first table section having a first game surface portion thereon;

a second table section having a second game surface portion thereon, wherein the first and second game surface portions form a contiguous game play surface;

at least one hinge attached to the first and second table sections and configured to permit the first and second table sections to be movable between a play position and a storage position;

a first game template removably positioned on the first and second game surface portions;

a plurality of rails, each rail attached to an edge of one of the first and second table sections and having a plurality of tab recesses and a plurality of cup holder recesses formed therein;

a plurality of multi-position tabs each slidably mounted over one of first and second table sections in one of the tab recesses and having a portion thereof extending over the first game template when positioned in a first position;

wherein each multi-position tab retracts from the first game template when positioned in a second position; and wherein a portion of each multi-position tab has an arcuate shape to mate with one of the cup holder recesses to complete a circumference of the cup holder recess when the multi-position tab is positioned in the second position.

2. The folding game table of claim 1 further comprising:

a second game template removably positioned on the second game surface portion;

at least one multi-position securing member slidably mounted to the second table section and having a portion thereof extending over the second game template when positioned in a first position; and wherein the at least one multi-position securing member retracts from the second game template when positioned in a second position.

3. The folding game table of claim 1 further comprising a fastener to attach the multi-position tabs in respective tab recesses.

4. The folding game table of claim 3 further comprising:

a stem attached to each multi-position tab and having an aperture formed therein, the stem insertable into a passage formed in one of the rails; and wherein the fastener comprises one of a compression-fitting grommet insertable into the aperture and a grommet attached to the tab with a threaded fastener.

5. The folding game table of claim 1 wherein each cup holder recess is cylindrically shaped and is configured to receive at least a cup therein.

6. The folding game table of claim 1 further comprising a removable backstop positioned adjacent to the play surface to form a wall for directing dice thrown thereagainst toward the play surface and constructed to slidably engage at least one of the pair of table sections.

7. The folding game table of claim 1 further comprising a plurality of foldable legs, each leg attached to at least one of the pair of table sections and constructed to support the folding game table when extended and storable within a storage volume when collapsed.

8. The folding game table of claim 1 further comprising at least one game piece storage compartment disposed in a play surface of the pair of table sections.

* * * * *

UNITED STATES PATENT AND TRADEMARK OFFICE

CERTIFICATE OF CORRECTION

PATENT NO. : 7,575,240 B1
APPLICATION NO. : 10/907475
DATED : August 18, 2009
INVENTOR(S) : Justin L. Voden It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 639 days.

Signed and Sealed this

Seventh Day of September, 2010

David J. Kappos

David J. Kappos
*Director of the United States Patent and Trademark Office*